United States Patent [19]

Reese

[11] 4,043,108

[45] Aug. 23, 1977

[54] YARN PROCESS

[75] Inventor: Cecil Everett Reese, Kinston, N.C.

[73] Assignee: E. I. Du Pont de Nemours and Company, Wilmington, Del.

[21] Appl. No.: 723,959

[22] Filed: Sept. 16, 1976

[51] Int. Cl.[2] ..... D02G 3/24; D02J 1/06; D01D 5/20

[52] U.S. Cl. ..... 57/157 R; 57/140 J; 28/246; 264/290 R

[58] Field of Search ..... 57/9, 34 R, 34 HS, 36, 57/37, 51.4, 55, 55.5, 140 R, 140 J, 157 R, 157 S, 157 MS, 157 TS; 28/72.12, 72.17, 75 R, 75 WT; 264/167, 210 R, 210 F, 290 R

[56] References Cited

U.S. PATENT DOCUMENTS

| | | | |
|---|---|---|---|
| 2,278,888 | 4/1942 | Lewis | 428/377 |
| 3,069,726 | 12/1962 | Adams | 57/140 J X |
| 3,212,158 | 10/1965 | Kasey | 28/72.17 X |
| 3,275,732 | 9/1966 | Maclead et al. | 364/290 |
| 3,439,489 | 4/1969 | Holton et al. | 428/399 |
| 3,444,682 | 5/1969 | Polacco et al. | 57/140 J |
| 3,660,550 | 5/1972 | Sempel | 264/290 N X |
| 3,662,055 | 5/1972 | Bates | 264/167 |
| 3,771,307 | 11/1973 | Petrille | 57/157 TS |
| 3,772,747 | 11/1973 | Buzano | 28/72.17 |
| 3,964,249 | 6/1976 | Werner et al. | 57/140 J |

FOREIGN PATENT DOCUMENTS

| | | |
|---|---|---|
| 2,221,551 | 10/1974 | France |

*Primary Examiner*—Donald Watkins

[57] ABSTRACT

A process for producing a feed yarn which can be draw-textured, without difficulty with filaments melting or sticking together, to have a programmed distribution of deeper-dyeing sections along the resulting false-twist textured yarn. The feed yarn is prepared by passing a spin-oriented polyester yarn in substantially undrawn condition past a source of heat where it is heated intermittently along its length to provide a programmed distribution of heat-treated sections. When drawn, the heat-treated sections will draw to a lesser extent and will then dye to deeper shades than the rest of the yarn.

7 Claims, 3 Drawing Figures

YARN PROCESS

BACKGROUND OF THE INVENTION

This invention relates to production of false-twist textured yarn of polyester filaments, and is more particularly concerned with a process for producing a feed yarn for draw-texturing into yarn having distributed therethrough portions which dye to deeper shades than other portions of the yarn.

Conventional processes for producing textile yarns of polyester filaments have involved melt-spinning polyethylene terephthalate into yarn at take-off speeds of 500 to 1,500 meters per minute (500 to 1,640 yards/minute). The take-off speed refers to the speed of the solidified yarn at windup or at roll for forwarding the yarn to subsequent processing.

Conventional as-spun yarn is usually drawn at a draw ratio of about 3.5 to 4.5X (3.5 to 4.5 times greater length) to produce the fully-drawn, uniform yarn of commerce. Alternatively, the yarn can be incompletely drawn to provide a random distribution of thick and thin sections along the filaments, of which the incompletely drawn thick sections have a higher dye uptake (dye to deeper shades) to provide attractive dyed fabrics. Lewis U.S. Pat. No. 2,278,888 discloses in Example V that the thin sections can be formed at desired locations along the yarn by contacting these portions of the yarn with a heated surface during drawing. Bates U.S. Pat. No. 3,662,055 discloses a programmed heating of portions along the yarn with a flame as the yarn is drawn. A running yarn can be intermittently vibrated in and out of contact with the flame by means of an electromagnetic vibrator acting on guides through which the yarn is passing. The vibrator can be programmed electrically according to any desired periodical or random or psuedo-random program and the program will be reproduced along the yarn in a corresponding arrangement of thick and thin sections. Instead of vibrating the yarn, the flame can be deflected in and out of contact with the yarn by modulating the flame or by deflecting the flame with an impinging stream of gas which is modulated in a programmed manner.

Petrille U.S. Pat. No. 3,771,307 discloses a false-twist texturing process for texturing spin-oriented polyester yarn prepared by melt-spinning at take-off speeds of 3,000 to 4,000 yards per minute (2,744 to 3,660 meters/minute). The as-spun yarn is drawn at a draw ratio of 1.3 to 2.0 as it is false-twist textured. The above methods, of intermittently heating conventional yarn while incompletely drawing the yarn to form thick and thin sections along the yarn, will not accomplish the desired result when used to produce a feed yarn for false-twist texturing processes. The incompletely drawn thick sections will melt or stick together at the high heater temperature used to set crimp in the yarn, or will be fully drawn at the tensions used. Spin-oriented yarn can be incompletely drawn while intermittently heating it to form thick and thin sections along the yarn, but the incompletely drawn thick sections of this feed yarn will be fully drawn at the temperatures and tensions used in draw-texturing processes and the desired deeper-dyeing sections will not be obtained.

SUMMARY OF THE INVENTION

The present invention provides a process for producing a feed yarn which can be draw-textured, without difficulty with filaments melting or sticking together, to have a programmed distribution of deeper-dyeing sections along the resulting false-twist textured yarn.

In the process of this invention, a spin-oriented polyester yarn is passed in a substantially undrawn condition past a source of heat where it is intermittently heated to provide a programmed distribution of heat-treated sections corresponding to the desired distribution of deeper-dyeing sections in the false-twist textured yarn to be produced from the treated yarn. The heating should be sufficient to provide heat-treated sections having a force to draw value which is at least 1.12 times the force to draw of adjacent sections along the yarn, and a density at least 0.005 gram per cubic centimeter greater than the density of adjacent sections.

Preferably, the heat-treated sections are about 0.5 to 2 inches in length. Lengths which are too short provide a less pleasing appearance when the yarn is draw-twist textured and used to prepare dyed fabric. On the other hand, the drawing performance is poor when yarn containing 3-inch or longer heated sections is draw-textured, resulting in an undesirable appearance in dyed fabric. Preferably the total length of the heat-treated sections is about 10 percent of the length of the yarn.

Any of the heating procedures of the prior art can be used to form heat-treated sections in accordance with the present invention. However, it should be noted that the deeper-dyeing sections of the prior art yarns are the unheated sections, whereas the opposite result is obtained in the process of the present invention. Preferably, the heat-treated sections of the present invention are formed by contacting the yarn with a surface heated to a temperature of about 190° C. Better heat transfer is provided by a heated metal surface, which is particularly desirable at the higher yarn speeds. The example illustrates the use of yarn speeds of about 300 to 600 feet per minute with the yarn being brought into contact with a heated pin about 240 to 1,200 times per minute; the advantage of a metal pin an Alsimag® pin is shown.

The treated feed yarn produced by the process of this invention is typically false-twist textured on a conventional draw-texturing machine, using a draw ratio of about 1.55X for yarn which would fully draw at a draw ratio of about 1.7X if the spin-oriented yarn had not been treated in accordance with this invention.

Definitions

Spin-oriented yarn is yarn which is withdrawn from the spinneret at a take-off roll speed greater than about 3,000 yards per minute (about 2,745 meters/minute) such as shown by Petrille in U.S. Pat. No. 3,771,307. The yarn has a birefringence greater than 0.025 and is substantially amorphous.

Relative viscosity (RV) is the ratio of the viscosity of a solution of 0.8 gram of polymer dissolved at room temperature in 10 ml of hexafluoroisopropanol to the viscosity of the hexafluoroisopropanol itself, both measured at 25° C in a capillary viscometer and expressed in the same units.

Break elongation, tenacity, and boil-off shrinkage are measured as in U.S. Pat. No. 3,772,872, Col. 2, 11. 17–33 and 49–55.

Cross-sectional area of a filament is measured by microscopic techniques or by calculation based on denier which may be measured on a standard Uster Evenness Tester.

Force-to-draw is the force required to draw a portion of the yarn 1.536X over a hot plate heated to 210° C. It is measured as follows:

The yarn to be tested is withdrawn from the bobbin and passed around two parallel rolls which rotate at a surface speed of 50 fpm (15.2 mpm). A sufficient number of wraps are taken to insure that there is no slippage. The yarn is passed through a strain gauge, thence over and just in contact with a heated, low friction 4.7-inch (about 12 cm) long hot plate at 210° C, over a second pair of draw rolls rotating at a speed to draw the yarn 1.536X and finally to a yarn take-up system. The length of yarn between the feed rolls and draw rolls is about 4 feet (about 122 cm). Again, enough wraps are taken on the draw rolls to insure that there is no slippage. The "force-to-draw" is measured by the strain gauge and appropriately recorded.

Birefringence is measured as shown in Piazza & Reese U.S. Pat. No. 3,772,872, at Col. 3, 11. 19–32.

Density, used as an indication of crystallinity, may be determined by the method described in "Physical Methods of Investigating Textiles", R. Meridith and J. W. S. Hearle, Textile Book Publishers, Inc. (1959) pages 174–176. Carbon tetrachloride and n-heptane are suitable liquids for use with polyethylene terephthalate. Density difference is the density of the treated portion of the yarn minus the density of the untreated portions.

DETAILED DESCRIPTION

Figure 1:
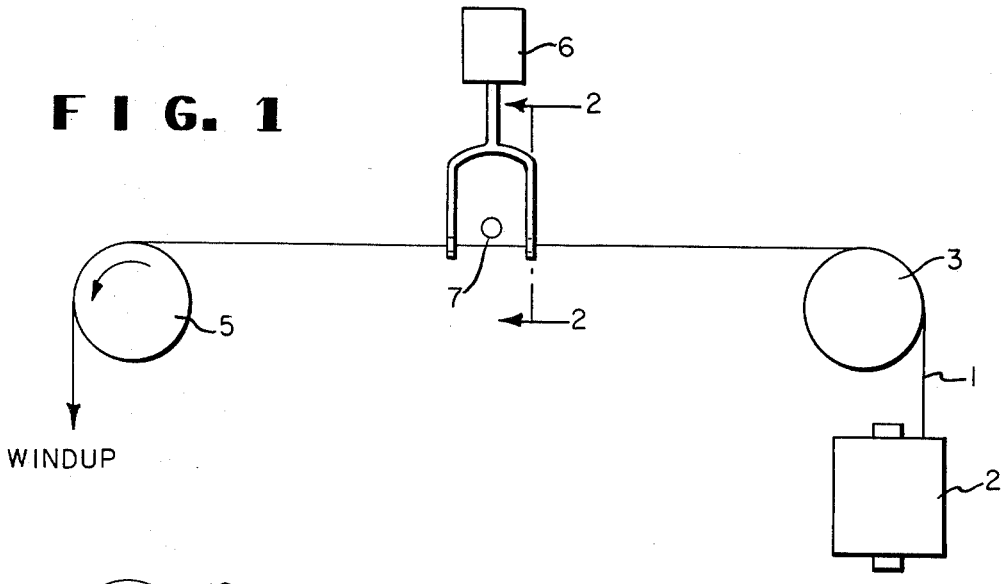
FIG. 1 is a schematic side view of a procedure for treating yarn in accordance with this invention.
Figure 2:
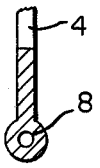
FIG. 2 is a partial cross-sectional view taken along line 2—2 of FIG. 1.

In the process illustrated in FIG. 1, as-spun spin-oriented yarn 1 from package 2 passes over feed roller 3, passes through two eyelets of yoke 4, over delivery roller 5, and is then packaged by a windup system (not shown). Feed roller 3 and delivery roller 5 have the same peripheral speed so that the yarn is not drawn during treatment. Yoke 4 is connected to reciprocating means 6 for moving the yoke rapidly up and down in a programmed manner. A heated cylindrical pin 7 is located between the tines of the yoke in position to contact the yarn during part of the movement of the yoke. As the yarn passes through the eyelets of the yoke it is caused to move into and out of contact with the hot pin. The heat of the pin causes the polyester to become more highly crystallized in the heated sections of the yarn than in the other portions of the yarn. FIG. 2 shows an eyelet 8 in the yoke, through which the yarn is passed to control its movement.

Figure 3:
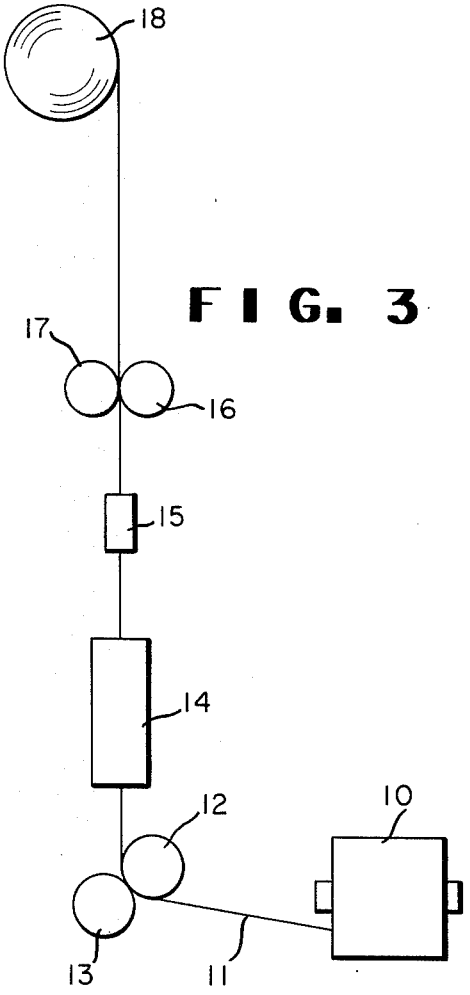
FIG. 3 is a schematic side view of an apparatus suitable for draw-texturing yarn produced by the process of this inventon.

FIG. 3 illustrates the process of false-twist texturing the treated yarn. This process will usually be performed by a customer, starting with a package 10 of yarn which has been produced as described above. Yarn 11 passes from the package between feed rolls 12 and 13, passes by texturing heater 14, is twisted by false-twist spindle 15, passes between upper rolls 16 and 17 and is wound up on package 18. The yarn is preferably draw-textured by driving the upper rollers at a higher speed than the feed rollers. The procedure is then as described in Petrille U.S. Pat. No. 3,771,307, except that a lower draw ratio is used because the heat-treated sections of the yarn draw to a lesser extent than the as-spun portions of the yarn.

Alternatively, the treated yarn can be drawn before it is false-twist textured. For example, the treated yarn can be drawn immediately after delivery roller 5 of FIG. 1, before the yarn is packaged. The drawn, packaged yarn would then be false-twist textured by processes conventionally used for fully drawn yarn. In either case, the heat-treated sections of the drawn yarn will dye to deeper shades than other sections.

EXAMPLE

A 235-denier spin-oriented polyester yarn is prepared by melt spinning 20 relative viscosity polyethylene terepthalate at 284° C, using a spinneret having 34 round orifices (each orifice 0.28 mm wide, 0.51 mm deep) and winding the filaments and 3,107 meters per minute (3,398 ypm). The yarn is interlaced during its travel to the windup as shown in U.S. Pat. No. 2,985,995 to a pin count of 40 centimeters (the length of yarn that passes by probe 18 of Hitt U.S. Pat. No. 3,290,932 before the probe is deflected about 1 mm. A force of about 8 gms is required to deflect the probe). The yarn has a birefringence of 0.038, a tenacity of 2.2 grams per denier, an elongation of 120%, and a boil-off shrinkage of 55%.

The spin-oriented yarn is treated as shown in FIG. 1. The yarns are wound up at about 0.5% less speed than the delivery roller speed. An Alsimag pin, 1.6 inches (4.06 cm) in diameter and 1.25 inches (3.2 cm) long, is used for runs 1–5 and a brass pin of the same dimensions is used for runs 6–9. Better results are obtained using the brass pin. The stroke of the yoke is such that the yarn actually contacts the pin about 10% of the running time.

Nine runs are made using conditions given in Table I. Feed and delivery rollers having the same peripheral speed ar used to provide the yarn speeds shown.

TABLE I

| Run | Min. (Meters/Min) | (Material) | Number of Contacts With Pin Per Minute |
|---|---|---|---|
| 1 | 300 (91.5) | 150 (Alsimag) | 240 |
| 2 | 300 (91.5) | 190 (Alsimag) | 240 |
| 3 | 300 (91.5) | 190 (Alsimag) | 1200 |
| 4 | 602 (184) | 190 (Alsimag) | 1200 |
| 5 | 602 (184) | 190 (Alsimag) | 240 |
| 6 | 602 (184) | 190 (Brass) | 240 |
| 7 | 602 (184) | 190 (Brass) | 1200 |
| 8 | 300 (91.5) | 190 (Brass) | 1200 |
| 9 | 300 (91.5) | 190 (Brass) | 240 |

In Runs 2, 7, 8 and 9, the yarn sections which contacted the hot pin have a force to draw of at least 1.12 times the force to draw of adjacent sections along the length of the yarn, and a density at last 0.005 gm/cc greater than the density of adjacent sections.

Each yarn is then draw-textured on an experimental single-position single-heater Leesona draw-texturing machine. Feed speed is 205 feet per minute (62.5 meters/min) and the yarn is drawn 1.55X; heater temperature in the twist zone is 196° C. The yarn is twisted 63 turns per inch (24.8 turns/cm) in the texturing zone. No melting occurs in the texturing zone. The deep-dyeing sections formed in the yarn have transverse cross-sectional areas which are from 1.05 to 2 times greater than those of adjacent sections.

Each of the textured yarns is knit (Jersey stitch) into a circular knit fabric, using a Lawson FKA knitter, and into a double knit (Pique stitch) fabric using a Stoll Knitter.

The fabrics are dyed with 2% (on weight of fabric) of Latyl Blue FLW. Fabric evaluation is shown in Table II.

TABLE II

| Fabric From Yarn | Evaluation |
|---|---|
| 1 | No deep-dyeing sections. |
| 2 | Deep-dyeing sections; very attractive circular knit fabric. Not much contrast in double knit fabric. |
| 3 | Numerous too-short deep-dyed sections. |
| 4 | No deep-dyeing sections. |
| 5 | No deep-dyeing sections. |
| 6 | Non-uniform appearance. |
| 7 | Deep-dyeing sections, very attractive fabric. |
| 8 | Deep-dyeing sections, most attractive fabric. |
| 9 | Deep-dyeing sections, very attractive fabric. |

Fabrics from yarns 2, 7, 8, 9 are fabrics of this invention. It is readily seen that the yarn speed, number of pin contacts and temperature and heat transfer properties of the pin are important considerations. A 150° C pin temperature was not sufficient for Yarn 1; the heat transfer properties of the Alsimag pin were not adequate for the high yarn speed of Yarns 4 and 5 nor for the high contact frequency for Yarn 3. The high speed and low contact frequency for Yarn 6 produced yarns having 3-inch long (7.6 cm) deep-dyeing sections which caused non-uniform drawing performance in texturing. Based on an understanding of the above table, one skilled in the art can readily adjust the process to suit his needs.

I claim:

1. In the process of producing spin-oriented polyester feed yarn for draw-texturing processes, the yarn treatment for providing a programmed distribution of deeper-dyeing sections along false-twist textured yarn resulting from draw-texturing the treated feed yarn; which comprises passing spin-oriented polyester yarn in a substantially undrawn condition past a source of heat and intermittently heating the yarn to provide a programmed distribution of heat-treated sections corresponding to the desired distribution of deeper-dyeing sections, said heating being sufficient for the heat-treated sections to have a force to draw value which is at least 1.12 times the force to draw of adjacent sections along the yarn and a density at least 0.005 gram per cubic centimeter greater than the density of the adjacent sections.

2. A process as defined in claim 1 wherein the heat-treated sections are about 0.5 to 2 inches in length.

3. A process as defined in claim 2 wherein the total length of the heat-treated sections is about 10 percent of the length of the yarn.

4. A process as defined in claim 1 wherein the heat-treated sections are formed by contacting the yarn with a surface heated to a temperature of about 190° C.

5. A process as defined in claim 4 wherein the heat-treated sections are formed by contacting the yarn with a heated metal surface.

6. A process as defined in claim 4 wherein the yarn speed is about 300 to 600 feet per minute and the yarn is brought into contact with a heated metal pin about 240 to 1,200 times per minute.

7. A process as defined in claim 1 wherein the treated feed yarn is subsequently false-twist textured on a draw-texturing machine, using a draw ratio of about 1.55X.

* * * * *